US010081917B2

(12) United States Patent
Irion et al.

(10) Patent No.: US 10,081,917 B2
(45) **Date of Patent: *Sep. 25, 2018**

(54) PLATE HANDLING SYSTEM INSERTING PLATE FROM GAGE SIDE

(71) Applicant: NORDCO INC., Oak Creek, WI (US)

(72) Inventors: Allan Irion, Milwaukee, WI (US); James Boyd, New Berlin, WI (US); Philip Strydom, Oak Creek, WI (US); Gregory Long, Mount Pleasant, WI (US)

(73) Assignee: NORDCO INC., Oak Creek, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/695,737

(22) Filed: Sep. 5, 2017

(65) Prior Publication Data

US 2017/0362778 A1 Dec. 21, 2017

Related U.S. Application Data

(63) Continuation-in-part of application No. 14/956,960, filed on Dec. 2, 2015, now Pat. No. 9,777,439.

(60) Provisional application No. 62/086,272, filed on Dec. 2, 2014.

(51) Int. Cl.
*E01B 29/10* (2006.01)
*E01B 29/22* (2006.01)

(52) U.S. Cl.
CPC ..... *E01B 29/10* (2013.01); *E01B 29/22* (2013.01)

(58) Field of Classification Search
CPC ..... E01B 29/05; E01B 29/06; E01B 29/10; E01B 29/32
USPC ..... 104/9, 16
See application file for complete search history.

(56) References Cited

U.S. PATENT DOCUMENTS 2,730,962 A * 1/1956 Wright ..... E01B 29/17 104/16
3,881,422 A * 5/1975 Bryan, Jr. ..... E01B 29/09 104/9
3,943,858 A * 3/1976 Dieringer ..... E01B 29/24 104/16
4,178,671 A * 12/1979 Luttig ..... E01B 29/24 104/16
4,241,663 A * 12/1980 Lund ..... E01B 29/24 104/16
4,691,639 A * 9/1987 Holley ..... E01B 29/32 104/16

(Continued)

*Primary Examiner* — Jason C Smith
(74) *Attorney, Agent, or Firm* — Greer, Burns & Crain, Ltd.

(57) ABSTRACT

A rail plate handling device is provided for removing and reinstalling rail tie plates located on rail ties on a railroad track, includes a frame configured for movement relative to the track, at least one tie plate gripping assembly mounted to the frame, the assembly configured for grasping a selected tie plate at the front and rear edges between an adjacent one of the at least one raised rail raised from the operational position supported by the selected tie plate and the associated tie in the operational position upon which the plate was resting, each gripping assembly including a pair of opposing gripping jaws which are configured for controlled reciprocation in a direction parallel to the rails along a guide bar, the guide bar being slidable with the gripping jaws and the selected plate, relative to the frame.

13 Claims, 17 Drawing Sheets

(56) References Cited

U.S. PATENT DOCUMENTS

| | | | | | |
|---|---|---|---|---|---|
| 4,942,822 | A * | 7/1990 | Cotic | E01B 29/32 | 104/16 |
| 4,974,518 | A * | 12/1990 | Cotic | E01B 29/32 | 104/16 |
| 5,063,856 | A * | 11/1991 | Theurer | E01B 29/32 | 104/7.1 |
| 5,331,899 | A * | 7/1994 | Holley | E01B 29/32 | 104/16 |
| 5,617,795 | A * | 4/1997 | Glomski | E01B 29/10 | 104/9 |
| 5,655,455 | A * | 8/1997 | Smith | E01B 29/32 | 104/16 |
| 5,722,325 | A | 3/1998 | Glomski et al. | | |
| 6,158,353 | A * | 12/2000 | Theurer | E01B 29/10 | 104/16 |
| 6,463,858 | B2 * | 10/2002 | Weber et al. | E01B 29/10 | 104/17.1 |
| 6,863,717 | B2 | 3/2005 | Johnsen et al. | | |
| 7,571,681 | B2 * | 8/2009 | Haughey | E01B 29/10 | 104/2 |
| 2003/0005850 | A1 * | 1/2003 | Johnsen | E01B 29/10 | 104/9 |
| 2003/0183116 | A1 * | 10/2003 | Johnsen | E01B 29/32 | 104/2 |
| 2007/0199473 | A1 * | 8/2007 | Fuerst | E01B 29/32 | 104/16 |
| 2007/0283837 | A1 * | 12/2007 | Brenny | E01B 29/32 | 104/16 |
| 2011/0072998 | A1 * | 3/2011 | Noll | E01B 29/32 | 104/16 |
| 2016/0153151 | A1 * | 6/2016 | Irion | E01B 29/10 | 104/9 |

* cited by examiner

PLATE HANDLING SYSTEM INSERTING PLATE FROM GAGE SIDE

RELATED APPLICATION

The present application is a Continuation-In-Part of U.S. Ser. No. 14/956,960 filed Dec. 2, 2015, which claims priority under 35 USC 119 from U.S. 62/086,272 filed Dec. 2, 2014, both of which are incorporated by reference.

BACKGROUND

This application relates generally to railway right-of-way maintenance equipment of the type used to repair and maintain railroad track. More specifically, the present invention relates to an apparatus for handling rail tie plates during replacement of rail ties.

Conventional railroad track consists of a plurality of spaced parallel wooden ties to which are attached a pair of spaced rail tie plates. Each tie plate is configured to rest on the upper surface of the tie and includes holes for receiving spikes or screws, as well as a canted seat or a cradle formation for receiving the bottom of the steel rail. Since two rails make up a railroad track, there are a pair of spaced tie plates on each tie. Some of the spikes are used to secure the tie plate on the tie and others are used to secure the base of the rail to the tie plate cradle.

During track maintenance operations, it is common to periodically remove worn out or rotten ties. This is accomplished by first removing the spikes which hold the plates to the tie as well as to the rail. Next, a machine, such as disclosed in commonly-assigned U.S. Pat. No. 6,463,858 which is incorporated by reference, lifts the rail and extracts the worn tie from underneath. As the tie is extracted, the loosened tie plates either fall into the rail bed or ballast, or are retained on the removed tie. Conventional practice is to manually remove the plates and throw them off to the side of the ballast so that they do not interfere with the replacement of the new tie. Once the new tie is inserted under the raised track, the plates must be reinserted in the appropriate position to support the rail and for re-spiking.

To avoid on the job injuries, especially those involved with handling tie plates, which typically weigh approximately 18-40 pounds and are heavy to manipulate, railways have attempted to mechanize the tie replacement and plate placement process as much as possible. One attempt has been to provide a mechanism which grips the plates and secures them to the rail as the tie is removed from beneath the plates. This system has not been widely accepted by the railroads because of its relatively complicated mechanism, and because in many instances the insertion of the new tie will cause particles of railway ballast to be retained on top of the tie and interfere with the repositioning of the tie plates. These conventional mechanisms have no way to remove unwanted ballast particles from the top surface of the tie.

Another drawback of conventional mechanized plate placement devices is that their speed is relatively slow and they cannot keep up with the other operations of the rail maintenance gang. Using manual removal and placement of tie plates, the tie replacement process typically operates at a rate of about 15 ties per minute. Conventional mechanized plate removal devices operate in the range of 3 to 5 ties per minute. At this point, this rate of production is unacceptable to the railroads.

Commonly-assigned U.S. Pat. No. 6,863,717 discloses a rail plate handling device that is designed for use in conjunction with the tie extraction and replacement machine disclosed in U.S. Pat. No. 6,463,858 discussed above. In operation, the plate handling device uses a pair of powered jaws to grasp the tie plate prior to tie extraction, and retract the plate away from the tie as it is extracted, then the jaws are released to drop the plate upon the rail ballast between the rails. The plates are then manually collected and repositioned for replacement of the ties. The device of the '717 patent was not commercially adopted due to operational speed constraints.

Thus, there is still a need for an improved rail plate handling device that decreases or eliminates manual handling of rail tie plates during the tie extraction and replacement process.

SUMMARY

The above-identified objects are met or exceeded by the present plate handling system which uses the device of the '717 patent and modifies the operation so that the tie plate is grasped, retracted from the tie and held suspended while the old tie is extracted and the new tie reinserted, then the device places the plate upon the tie and reinserts the plate from the gage side. Alignment of the plate on the foot of the rail is achieved by using a control mechanism for manipulating gripping and lifting cylinders to lift one end of the plate so that a lip of the plate engages a foot of the raised rail. In more detail, after the tie plate is grasped, retracted to the gage side the rail is lowered, and the tie plate is then held suspended above the track on the gage side of the rail pending the extraction of the tie. The tie is then extracted, moved out of the way of the operation, and a new tie is obtained and inserted while the plate continues to be held suspended above the track. Upon insertion of a new tie, the rail is lifted, and the plate is lowered upon the upper surface of the tie. Next, the plate is pushed towards the lifted rail from the gage side, and is ultimately lifted off the tie on the gage side of the plate as the plate is pushed. The plate is pushed until the field side lip or shoulder of the plate is under the lifted rail, and the gage side lip then engages the foot of the raised rail, assuring proper left-to-right plate placement upon the tie. The rail is then lowered, and the device releases the jaws which had grasped the tie plate, and the jaws are moved out of the way of the rail so that the device is movable to the next tie needing replacement.

More specifically, a rail plate handling device is provided for removing and reinstalling plates located on rail ties on a railroad track having a pair of rails, each tie plate supporting one of the rails on an associated tie and having front and rear edges corresponding to the direction of travel along the railroad track, wherein at least one of the rails is raised from an operational position during the plate removal and installation process. The device includes a frame configured for movement relative to the track; at least one tie plate gripping assembly mounted to the frame, the assembly configured for grasping a selected tie plate at the front and rear edges between an adjacent one of the at least one raised rail raised from the operational position supported by the selected tie plate and the associated tie in the operational position upon which the plate was resting, pulling the selected plate away from the adjacent raised rail and away from the associated tie, retaining the selected plate in a suspended position above the track while the tie is extracted and a new tie inserted, and then replacing the suspended tie plate back upon the rail from a gage side of the rail.

The device includes at least one plate retracting cylinder constructed and arranged for retracting the plate from beneath the rail and for suspending the plate above the track, and also for lowering the plate back upon the rail and inserting the plate beneath the rail from the gage side.

The device includes a control mechanism connected to at least one retracting cylinder, and is constructed and arranged for manipulating the at least one cylinder for lifting a gage side of the selected tie plate from the tie as the plate is moved along the tie towards the rail, and for manipulating the tie plate so that a lip of the plate engages a foot of the associated rail.

The at least one gripping assembly is configured for pulling the plate upwardly away from the tie in a first operational direction, and pushing the plate upon the tie and towards the associated rail in a second, reverse operational direction.

A control mechanism is provided for sequentially triggering and controlling the lowering of the at least one tie plate gripping assembly mounted to the frame to the operational vicinity of a tie plate, the grasping of a selected tie plate, the pulling the plate inwardly away from the rail and upwardly away from the tie, the suspension of the tie plate above the track while the tie is extracted and a new tie inserted, replacing the same tie plate upon the new tie, and moving the tie plate along the new tie towards the associated rail from a gage side of the rail.

In another embodiment, a rail plate handling device for removing plates located on rail ties on a railroad track having a pair of rails, and includes a frame configured for movement relative to the track; at least one subframe pivotally engaged on the frame for movement between a raised and a lowered position; at least one tie plate gripping assembly mounted each subframe, the subframe including a pair of opposed gripping jaws configured for grasping a selected tie plate; and a control system connected to the at least one tie plate gripping assembly for removing a selected tie plate away from the rail from a gage side of the rail and for retaining the tie plate while the tie is replaced, and for replacing the tie plate upon a new tie and moving the tie plate towards the associated rail from the gage side.

In yet another embodiment, a method is provided for removing tie plates from railroad ties on a railroad track including a pair of rails, and includes:

grasping front and rear edges of a selected tie plate;

retracting the grasped tie plate in a direction away from the respective rail;

simultaneously raising the grasped tie plate to separate it from the corresponding tie;

suspending the grasped tie plate above the track while the tie is exchanged;

lowering the grasped tie plate upon the new tie; and moving the tie plate along the new tie towards the rail from the gage side.

The method further includes raising a gage side of the tie plate as the plate is moved towards the rail so that a lip of the plate engages a foot of the rail.

In still another embodiment, a process is provided for replacing a tie plate on a railroad track during exchange of a tie, using a movable tie plate exchange device having at least one pivoting subframe and a pair of opposed, tie plate gripping jaws, including:

a. extending and lowering jaw-bearing arms of each subframe;

b. closing the jaws;

c. lifting the rail;

d. retracting and raising the arms, holding the plate suspended above the track;

e. lowering the rail;

f. removing the tie using a tie exchanging apparatus;

g. obtaining a new tie and inserting the tie beneath the rail in the location of the previous tie;

h. lifting the rail;

i. lowering arms of the subframe, such the plate is located on top of the tie;

j. extending the plates toward the rail, such the field side lip of the plate is part way under the rail;

k. raising a gage side of the plate and continuing to move the plate towards the rail;

l. the gage side lip of the plate engages the base of the rail, assuring proper left to right placement.

m. lowering the rail; and n. releasing the jaws, return the subframe to a travel position.

In a further embodiment, in conjunction with the present tie plate replacement system, an optional tie exchange process is provided and includes a pivoting lifting device that lifts an extracted tie away from the track along an arc and places it in a first position, then pivots to obtain a new tie located in a second position, and moving the new tie to an insertion position transverse to the tie.

In a still further embodiment, a rail plate handling device is provided for removing and reinstalling rail tie plates located on rail ties on a railroad track having a pair of rails, each tie plate supporting one of the rails on an associated tie and having front and rear edges corresponding to the direction of travel along the railroad track, wherein at least one of the rails is raised from an operational position during the plate removal and installation process. The device includes a frame configured for movement relative to the track, at least one tie plate gripping assembly mounted to the frame, the assembly configured for grasping a selected tie plate at the front and rear edges between an adjacent one of the at least one raised rail raised from the operational position supported by the selected tie plate and the associated tie in the operational position upon which the plate was resting, each gripping assembly including a pair of opposing gripping jaws which are configured for controlled reciprocation in a direction parallel to the rails along a guide bar, the guide bar being slidable with the gripping jaws and the selected plate, relative to the frame.

In still another embodiment, a rail plate handling device is provided for removing plates located on rail ties on a railroad track having a pair of rails, and includes a frame configured for movement relative to the track, at least one subframe pivotally engaged on the frame for movement between a raised and a lowered position at least one tie plate gripping assembly mounted each subframe, the subframe including a pair of opposed gripping jaws configured for grasping a selected tie plate, the gripping jaws being disposed on a jaw guide bar that is slidably engaged on the subframe. A control system is connected to the at least one tie plate gripping assembly for removing a selected tie plate away from the rail from a gage side of the rail and for retaining the tie plate while the tie is replaced, and for replacing the tie plate upon a new tie and moving the tie plate towards the associated rail from the gage side.

In a still further embodiment, a process is provided for replacing a tie plate on a railroad track during exchange of a tie, using a movable tie plate exchange device having at least one pivoting subframe and a pair of opposed, tie plate gripping jaws. The process includes:

a. extending and lowering jaw-bearing arms of each subframe;

b. closing the jaws;

c. lifting the rail;

d. retracting and raising the arms, holding the plate suspended above the track;

e. lowering the rail;

f. removing the tie using a tie exchanging apparatus;

g. obtaining a new tie and inserting the tie beneath the rail in the location of the previous tie;

h. lifting the rail;

i. lowering arms of the subframe, such the plate is located on top of the tie;

j. gripping the plate using a pair of gripping jaws located on a jaw guide bar, the jaw guide bar being slidable relative to the subframe;

k. extending the plates toward the rail, such the field side lip of the plate is part way under the rail;

l. raising a gage side of the plate and continuing to move the plate towards the rail;

m. the gage side lip of the plate engages the base of the rail, assuring proper left to right placement.

n. lowering the rail; and o. releasing the jaws, return the subframe to a travel position.

DETAILED DESCRIPTION OF THE INVENTION

Figure 1:
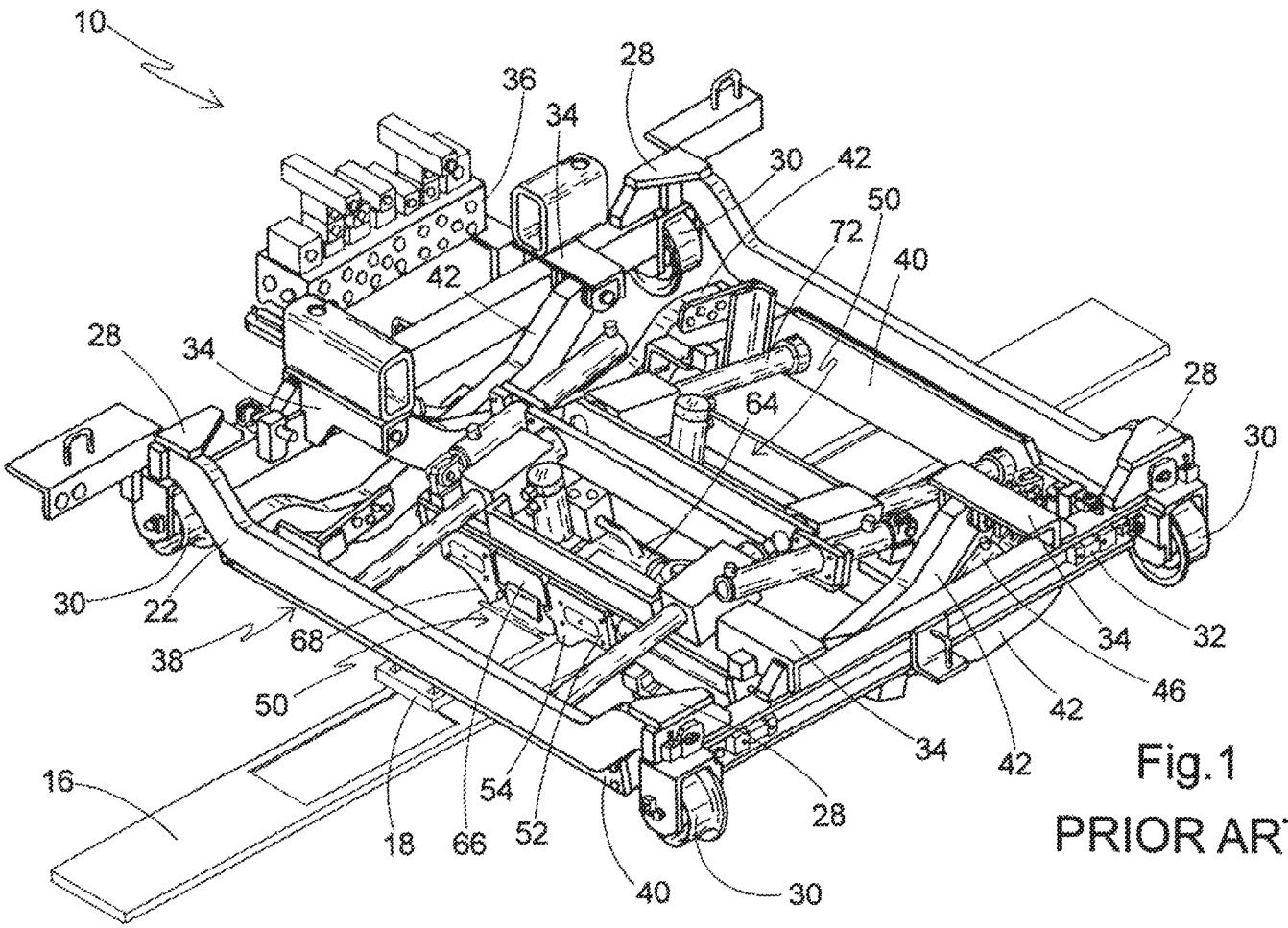
Fig.1 PRIOR ART
FIG. 1 is a top perspective elevation of a prior art plate handling device, shown in a rest position.
Figure 2:
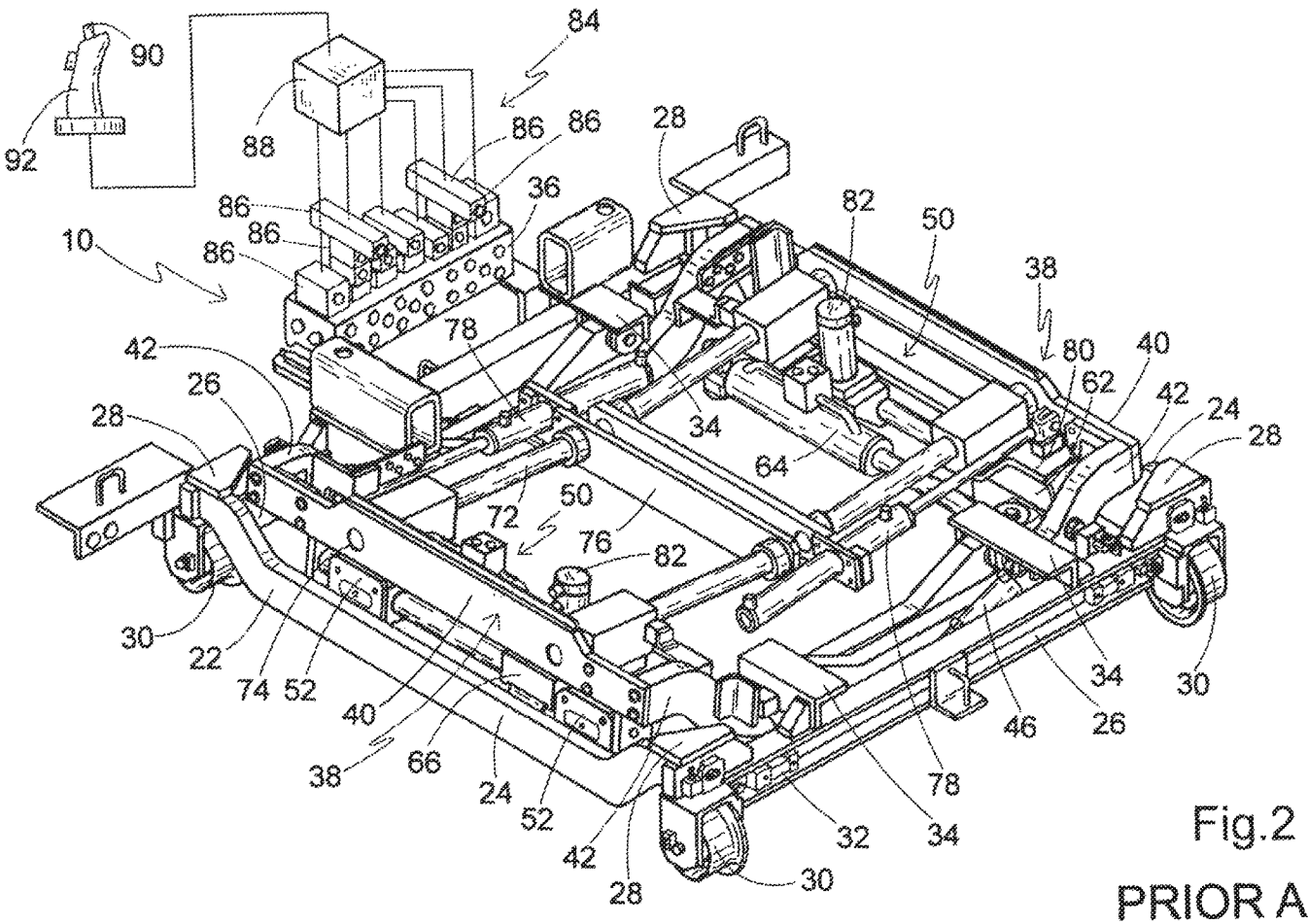
Fig.2 PRIOR ART
FIG. 2 is a top perspective elevation of the prior art rail maintenance device incorporating the present rail tie plate handling system, shown in the tie plate selection position.
Figure 3:
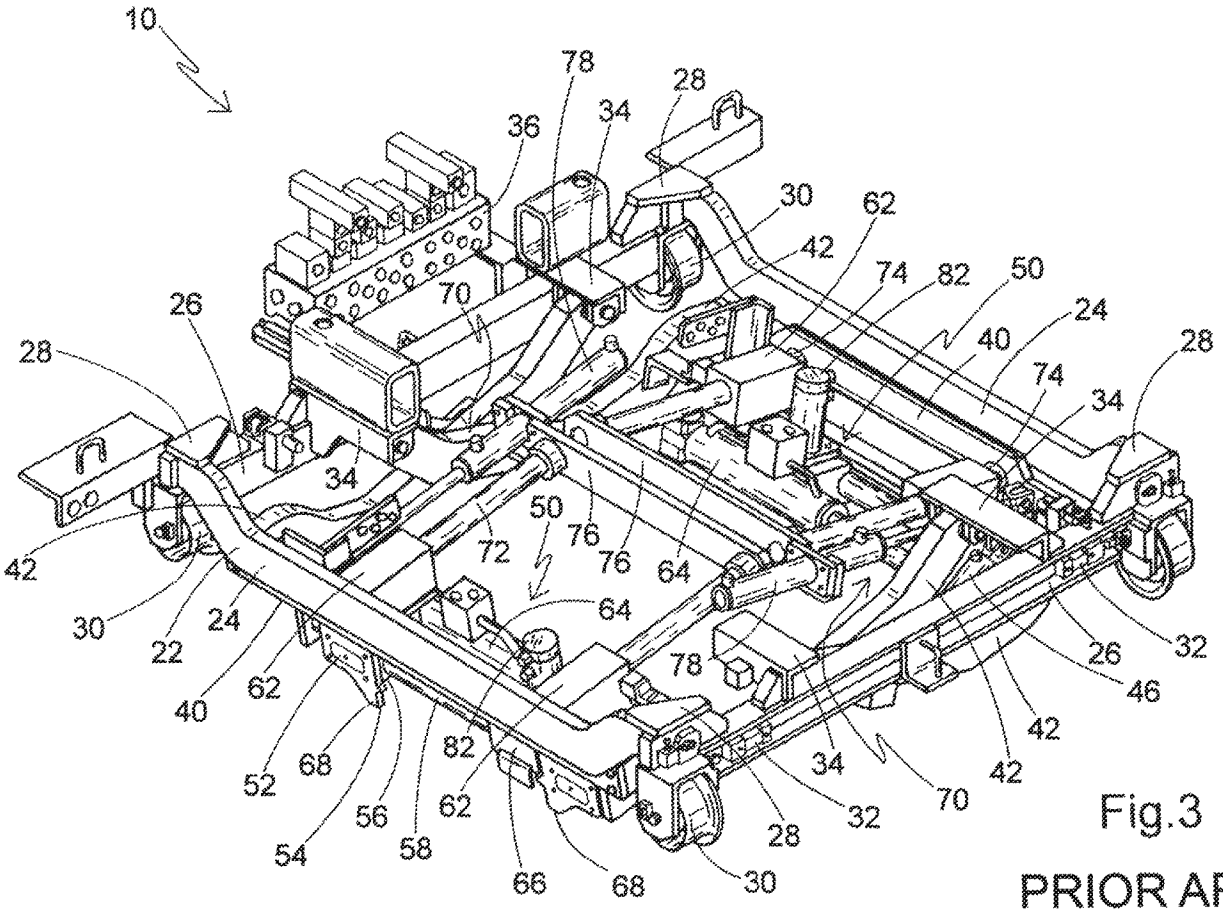
Fig.3 PRIOR ART
FIG. 3 is a perspective elevation of the device of FIG. 1 shown in the tie plate grasping position.

Referring now to FIGS. 1-4, a railroad maintenance rail tie plate handling system features a device generally designated 10, which is disclosed in greater detail in U.S. Pat. No. 6,863,717, incorporated by reference. The present system represents a new operational sequence for the device disclosed in the above-referenced patent. The rail tie plate handling device 10 is specifically designed for use in removing tie plates from a railroad track 12, which is made up of a pair of space rails 14, which are secured to a plurality of spaced, parallel ties 16 by a plurality of tie plates 18. As is well known, the ties 16 are typically wood, but are also made of concrete in some applications. The present application is concerned with track laid upon wooden ties 16, which periodically need replacement due to natural deterioration. As is known in the art, the tie plates 18 are secured to the ties 16 by spikes 20 or threaded fasteners. Only a few spikes 20 are depicted in FIG. 3, since at that stage of the rail maintenance operation, all of the spikes would be withdrawn from tie plates about to be removed. The present device and/or system is preferably designed for use in conjunction with a rail tie extraction apparatus of the type disclosed in commonly assigned U.S. Pat. No. 6,463,858, which is incorporated by reference. However, it is contemplated that the device 10 may alternately be provided as a self-propelled unit independently movable along the track 12, having an operator's control station and a power source as is known in the art.

The present device 10 includes a main frame 22 configured for movement relative to the track 12 and provided with a pair of generally parallel side members 24 and a pair of end members 26, which are connected at respective corners 28 to form a square or rectangular frame shape. Flanged rail wheels 30 are rotatably mounted at each corner 28. In the preferred embodiment, each wheel 30 is provided with a centering mechanism on each side of the frame for centering the main frame 22 relative to the track 12. In the preferred embodiment, the adjustment mechanism includes a centering cylinder 32 mounted to the frame 22 and configured for positioning the corresponding wheel relative to the frame 22. The cylinder 32 is a fluid power cylinder (hydraulic or pneumatic), but hydraulic types are preferred, as is the case with all of the fluid power cylinders in the device 10 described below. A feature of the invention is that, by adjusting the relative pressure to, and extension of, the cylinders 32, the frame 22 is maintained in a centered position upon the track 12.

Also found on the frame 22 is at least one and preferably four anchor points 34 preferably located on the end members 26. The anchor points 34 are provided in pairs, with one associated anchor point on each corresponding end member 26. A hydraulic control module and manifold 36 is also secured to the frame 22 for controlling the fluid flow to the various fluid power cylinders described below.

Attached to the frame 22 are at least one and preferably two generally "U"-shaped subframes 38, each being provided with a base member 40 to which are attached a pair of aims 42. Each arm 42 has a free end 44 which is pivotally secured to a corresponding one of the anchor points 34. In the preferred embodiment, the anchor points 34 are clevis mounts with the free ends 44 located between the clevis blades, however it is contemplated that a reversed orientation could also be suitable, provided secure pivoting action is achieved. In the preferred embodiment, two subframes 38 are secured to the frame 22 so that each of the bases 40 is associated with a corresponding side member 24. However, it is contemplated that the number and orientation of the subframes 38 may vary to suit the application.

Figure 4:
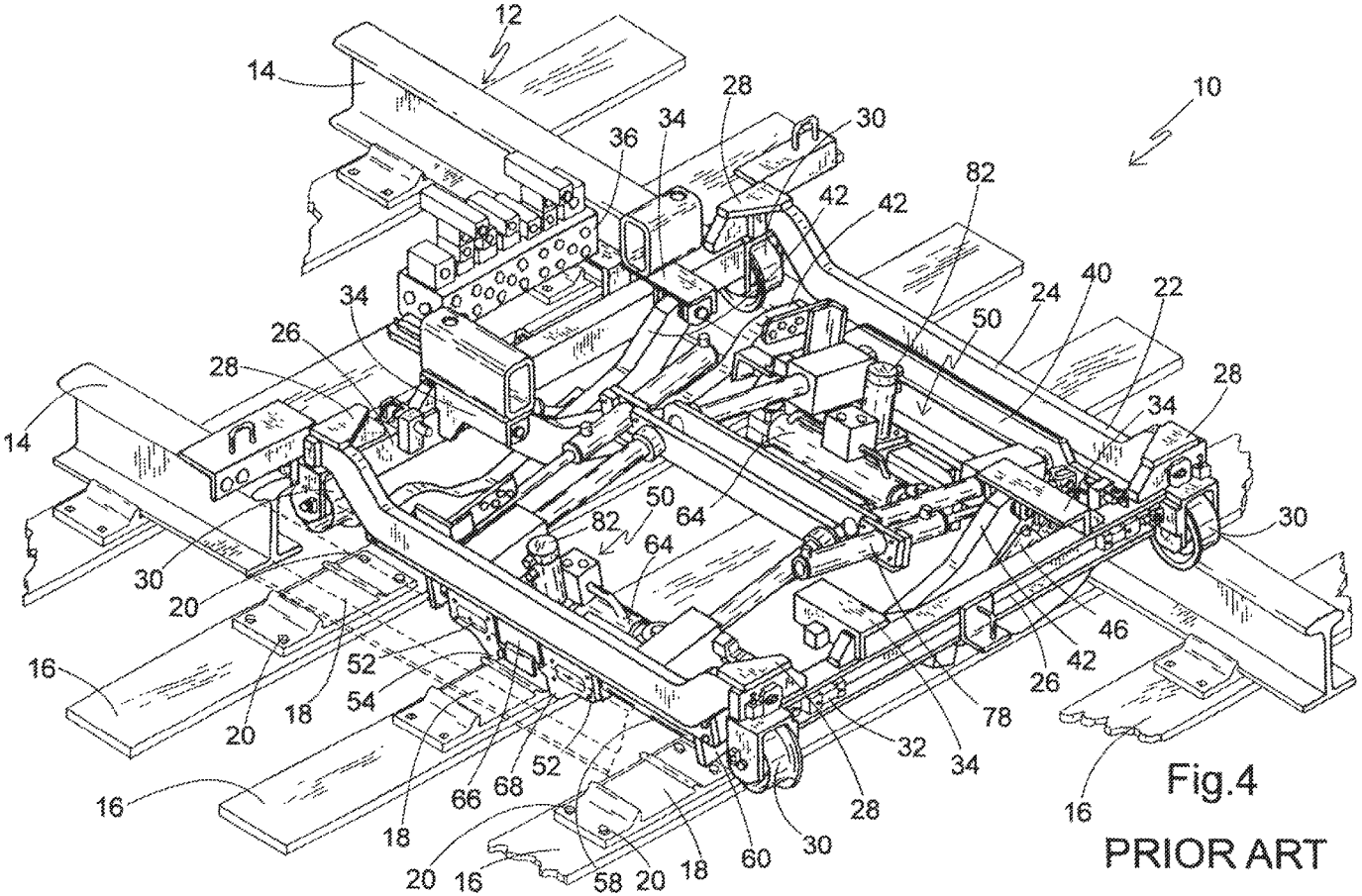
Fig.4 PRIOR ART
FIG. 4 is a perspective elevation of the device of FIG. 1 shown in the tie plate retracting position.

The pivoting action of each of the subframes 38 relative to the frame 22 is controlled by a corresponding subframe control cylinder 46 (best seen in FIG. 1) which is connected at one end to the subframe and at the other end to the frame 22 near the anchor point 34. Preferably using a clevis mount, although other pivotal cylinder mounts are contemplated, the subframe control cylinders 46 are secured to the anchor point 34 so that extension and retraction of the cylinder will cause the subframe to pivot down and up respectively, relative to the frame 22. A raised or rest position in which the control cylinders 46 are retracted is depicted in FIG. 1, and a lowered or plate-engaging position in which the control cylinders are extended is depicted in FIGS. 2-4.

Also included in the device 10, and mounted on at least one of the subframes 38 and ultimately to the frame 22, is at least one tie plate gripping assembly 50 configured for grasping a selected tie plate 18, pulling the plate away from the rail 14 and away from the tie 16, and subsequently releasing the plate. While, in the preferred embodiment, the device 10 in general, and the subframes 38 and the gripping assembly 50 specifically, are configured to move the grasped tie plate 18 inwardly away from the rail 14 and upwardly on an incline away from the tie 16, it is contemplated that other directions of separation of the plate from the track are contemplated, including outwardly away from the rail and/or horizontally away from the tie. More specifically, each gripping assembly 50, of which there are preferably two on the device 10, is associated with a corresponding side member 24. While two assemblies 50 and subframes 38 are preferably provided in the device 10, for simplicity, the construction and operation of only one of the subframes 38 will be described here. It will be understood that both subframes 38 and their associated components operate in the same manner Included on each gripping assembly 50 is at least a pair of opposing jaws 52 which include a plate-engaging blade 54 and a throughbore 56 for slidably engaging a jaw guide bar 58. The jaws 52 reciprocate under operator control on the assembly 50 in a direction parallel to the corresponding rail 14. The jaw guide bar 58 is fastened at each end to a flange 60 on a guide block 62, two of which are provided to each gripping assembly 50. Movement of each of the jaws 52 is controlled by a gripping cylinder 64, each end of which is connected to a clevis or equivalent mount on a corresponding one of the jaws 52. Thus, retraction of the gripping cylinder 64 will bring the jaws 52 together, and extension of the gripping cylinder will separate the jaws.

A rail plate-contacting guide 66 is preferably freely slidably engaged on the jaw guide bar 58 between the two jaws 52. As the gripping cylinder 64 retracts and the jaws 52 grip corresponding front and rear edges of the tie plate 18 (best seen in FIG. 4), the plate contacting guide 66 will engage an upper surface of the plate being gripped and ensure that the blades 54 are in proper contact with the plate. As the guide 66 contacts the upper surface of the tie plate 18, the subframe 38 will move up or down respectively to maintain the proper engagement. The blades 54 are configured with a depending lobe 68 for digging into the tie 16 when necessary to positively engage plates 18 which become embedded into the wood over time.

Referring now to FIG. 2, each of the gripping assemblies 50 also includes a retracting mechanism 70 for moving the gripping assembly upward and away from the tie 16 along an inclined path defined by the pivoted subframe 38, which has pivoted downward toward the track 12 through the extension of the subframe control cylinder 46. As described above, alternate directions of tie plate displacement are contemplated. The retracting mechanism 70 includes a pair of guide rods 72 which are secured at one end in bores 74 in the base 40, on the way slidably passing through the guide blocks 62, and at an opposite end to a stabilizer bar 76. At least one fluid power-retracting cylinder 78 is connected to the stabilizer bar 76 at one end, and at the opposite end to a flange 80 (best seen in FIG. 1) extending from the guide block 62.

A tie jack 82 is preferably provided to the gripping assembly 50 for facilitating the removal of the tie plate 18 from the tie 16. Very often, upon the gripping of the tie plate 18 by the jaws 52, the tie 16 does not immediately become detached from the plate. To facilitate this detachment, the tie jack 82 includes a piston shaft (not shown), which depends generally vertically under fluid power to press against the tie 16 and disengage it from the tie plate 18. The tie jack 82 is preferably laterally offset from the gripping jaws 52 so that, upon the gripping engagement of the tie plate 18 by the jaws, the tie jack shaft will contact the tie 16.

Referring now to FIG. 1, the present device 10 includes a control mechanism 84 for controlling the plate gripping and moving operations. Included in the control mechanism 84 is the hydraulic manifold 36 which receives the fluid power (preferably hydraulic) lines which are connected to the various cylinders 32, 46, 64, 78 and 82. The manifold 36 is also connected to a plurality of hydraulic control valves 86 which, with the hydraulic lines and the cylinders 32, 46, 64, 78 and 82 form a hydraulic circuit as is well known in the art. The valves 86 are preferably automatically operated by a control circuit (schematically indicated at 88) of the type known in the art, and are preferably triggered by an operator actuating a button or switch 90 on an operator-manipulated control device 92, preferably a joystick, however other equivalent control units are contemplated. By manipulating the button or switch 90, the operator controls the tie plate gripping operation, including the sequential lowering of the subframe 38 with its associated gripping assembly 50, the movement of the gripping jaws 52 to grasp a selected tie plate 18, the inward movement of the gripping assembly 50 away from the rail and upwardly away from the tie, the retention of the plate suspended above the track while the tie is exchanged, and the replacement of the tie plate upon the tie as described in more detail below. It will be appreciated that once the plate gripping cycle is initiated, some of the hydraulically controlled tasks are performed automatically, as is well known in the art.

In operation, and referring now to FIG. 2, the present device 10 moves along the track 12 until the operator locates a tie 16 needing replacement. The various plate gripping and moving components are in their "at rest" or inactive positions. Using the joystick 92, the device 10 is positioned relative to the tie 16 in question so that the tie is between the gripping jaws 52. However, the specific position of the device 10 relative to the subject tie 16 may vary with each gripping cycle. Once the device 10 is in position, the operator actuates the switch or button 90 to initiate the automatic sequence described below.

Referring now to FIG. 2, the subframe control cylinder 46 is extended so that the subframe 38 pivots about the anchor points 34. In this position, the base 40 is in close proximity to the corresponding rail 14, and the subframe arms 42 are inclined upward from the frame side member 24 to the middle of the main frame 22. The gripping assembly 50 is positioned adjacent the base 40 of the subframe 38.

Referring now to FIG. 3, next, the gripping cylinder 64 is retracted, bringing the gripping jaws 52 together about a tie plate 18. Since the device 10 may not always encounter the tie plate 18 at the same position, the gripping jaws 52 are configured so that whichever jaw 52 is closer to the tie plate 18 engages the plate first, and the other jaw 52 has to travel the farther distance to grip the opposite edge of the tie plate. To maintain the gripping jaws 52 at the proper height, the plate contacting guide 66 contacts an upper surface of the tie plate as the gripping jaws 52 come together about the plate. The contacting guide causes the subframe 38 to be raised or lowered if necessary to optimize the gripping action of the jaws 52.

Once the plate 18 has been securely gripped as described above, at this time, if the tie plate 18 has not become totally detached from the tie 16, the tie jack 82 is engaged, which impacts the tie and ensures its separation from the plate. At this time, the rail 14 is lifted from the tie, using a rail lifting clamp and cylinder on the associated tie extraction device described in U.S. Pat. No. 6,463,858 or a separate piece of equipment.

Referring now to FIG. 4, once the plate 18 has been securely gripped at its forward and rear edges by the gripping jaws 52, the automatic control circuit 88 is configured to cause the retracting cylinders 78 to retract, pulling the gripping assembly 50 up the incline of the subframe 38, and toward the middle of the device 10. The guide rods 72 have sufficient length to pull the tie plate 18 toward the middle of the device 10 so that it is away from the rail 14.

Figure 5:
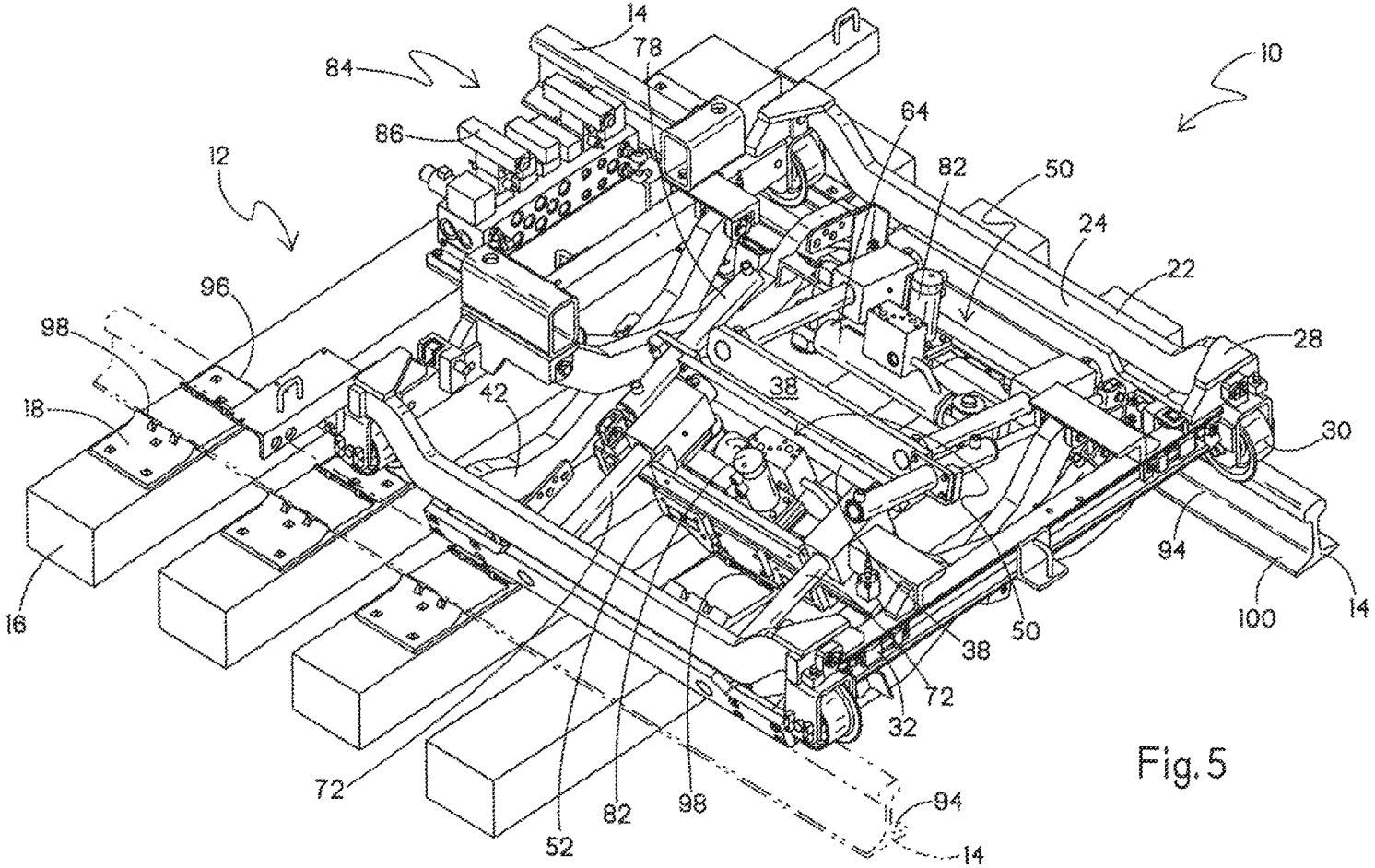
FIG. 5 is a perspective elevation of the present device of FIG. 1 shown in the tie plate lowering position.

Referring now to FIG. 5, once the retracting cylinders 78 are fully retracted, the gripping assembly 50 is in its centermost and uppermost position in the operational cycle. The plate 18 is shown suspended above the track 12. At this point, the rail 14 is lowered and tie 16 is removed by being gripped by a separate tie extraction apparatus, preferably of the type disclosed in commonly assigned U.S. Pat. No. 6,463,858. A new tie 16 will be inserted to replace the old one just extracted. An optional procedure for exchanging the tie 16 is described below in connection with FIG. 13.

Figure 6:
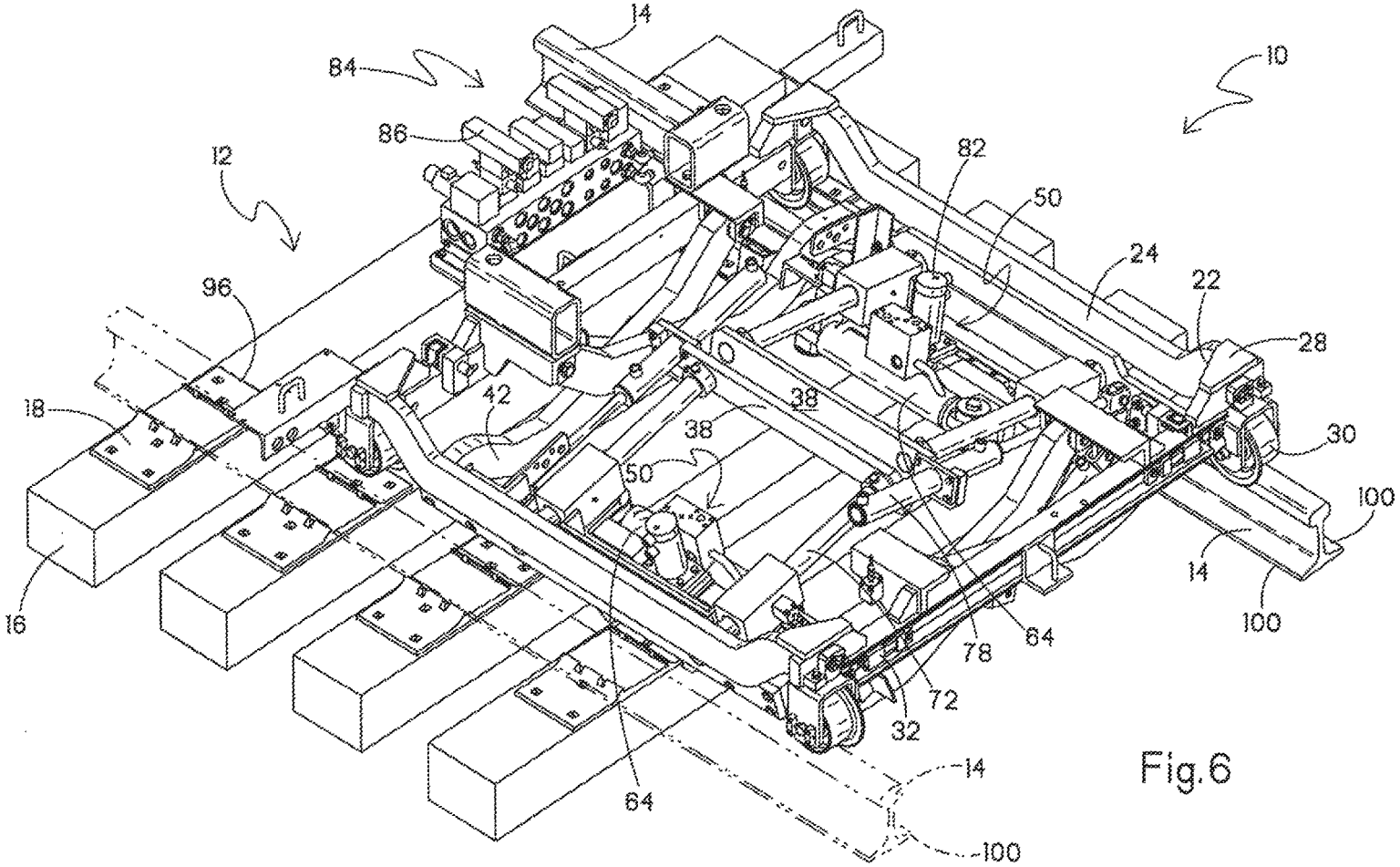
FIG. 6 is a perspective elevation of the device of FIG. 1 shown with the tie plate being extended beneath a raised rail.
Figure 9:
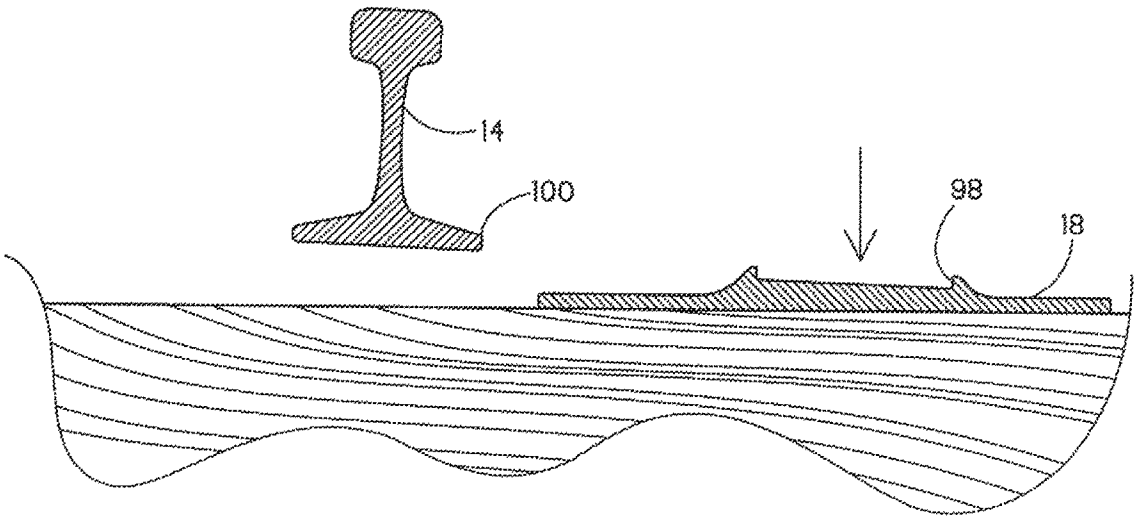
FIG. 9 is a schematic side elevation of the present method with the tie plate shown being grasped.

Referring now to FIGS. 6 and 9, the rail 14 is lifted, preferably by the tie extraction machine described above. Under the control of the control mechanism 84, the retracting cylinders 78 are extended to move the jaws 52 and the secured tie plate 18 back towards the new tie 16. The cylinders 78 are extended until the plate 18 is set upon the tie.

Figure 7:
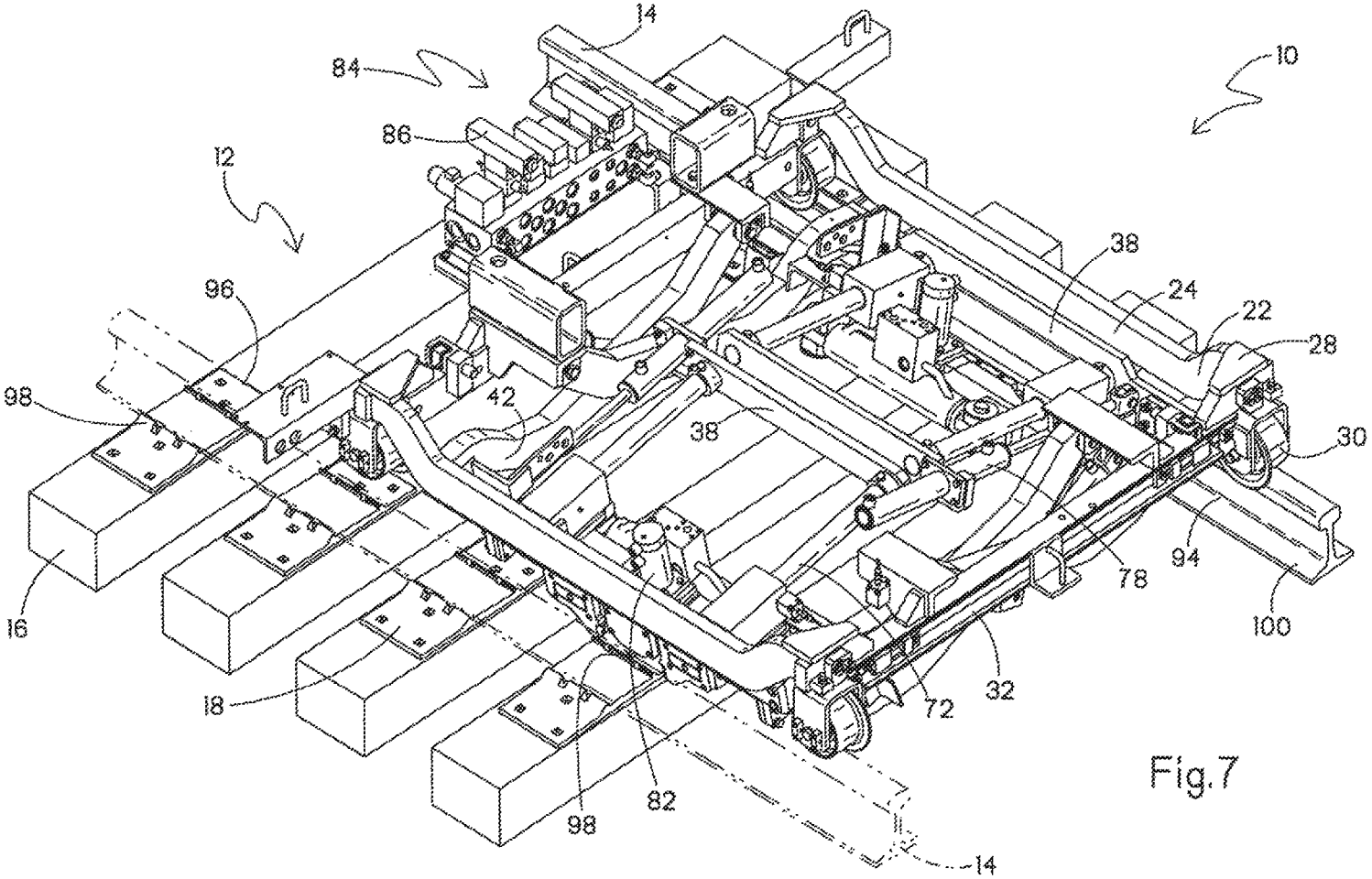
FIG. 7 is a perspective elevation of the device of FIG. 1 shown with the tie plate pushed out and lifted at one end.
Figure 10:
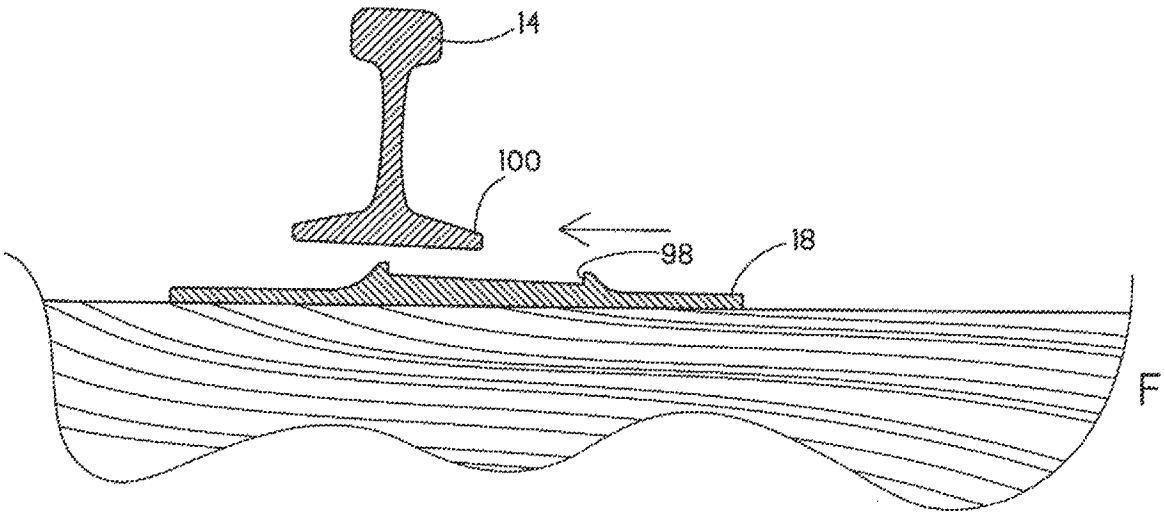
FIG. 10 is a schematic side elevation of the present method with the tie plate shown being pushed upon the tie towards the rail.

Next, referring to FIGS. 7 and 10, further extension of the retracting cylinders 78 causes the plate 18 to move towards the rail 14 on the gage side 94. Eventually, the plate 18 will begin to move beneath the raised rail (FIG. 10).

Figure 11:
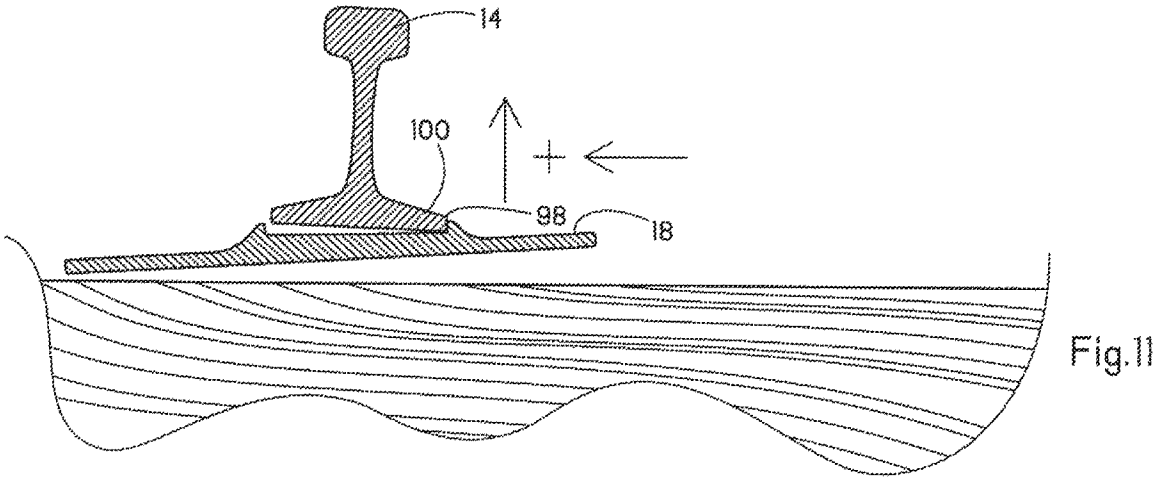
FIG. 11 is a schematic side elevation of the present method showing the tie plate being lifted at one end and slid further towards the rail until a shoulder of the plate engages the rail foot.

Referring now to FIGS. 7 and 11, through manipulation of the retracting cylinders 78 and the optionally the gripping cylinders 64, the plate 18 is raised at a gage side end 96 so that a shoulder or lip 98 of the plate engages a foot 100 of the rail 14. This step enhances the alignment of the plate 18 upon the tie 16, and relative to the rail 14.

Figure 8:
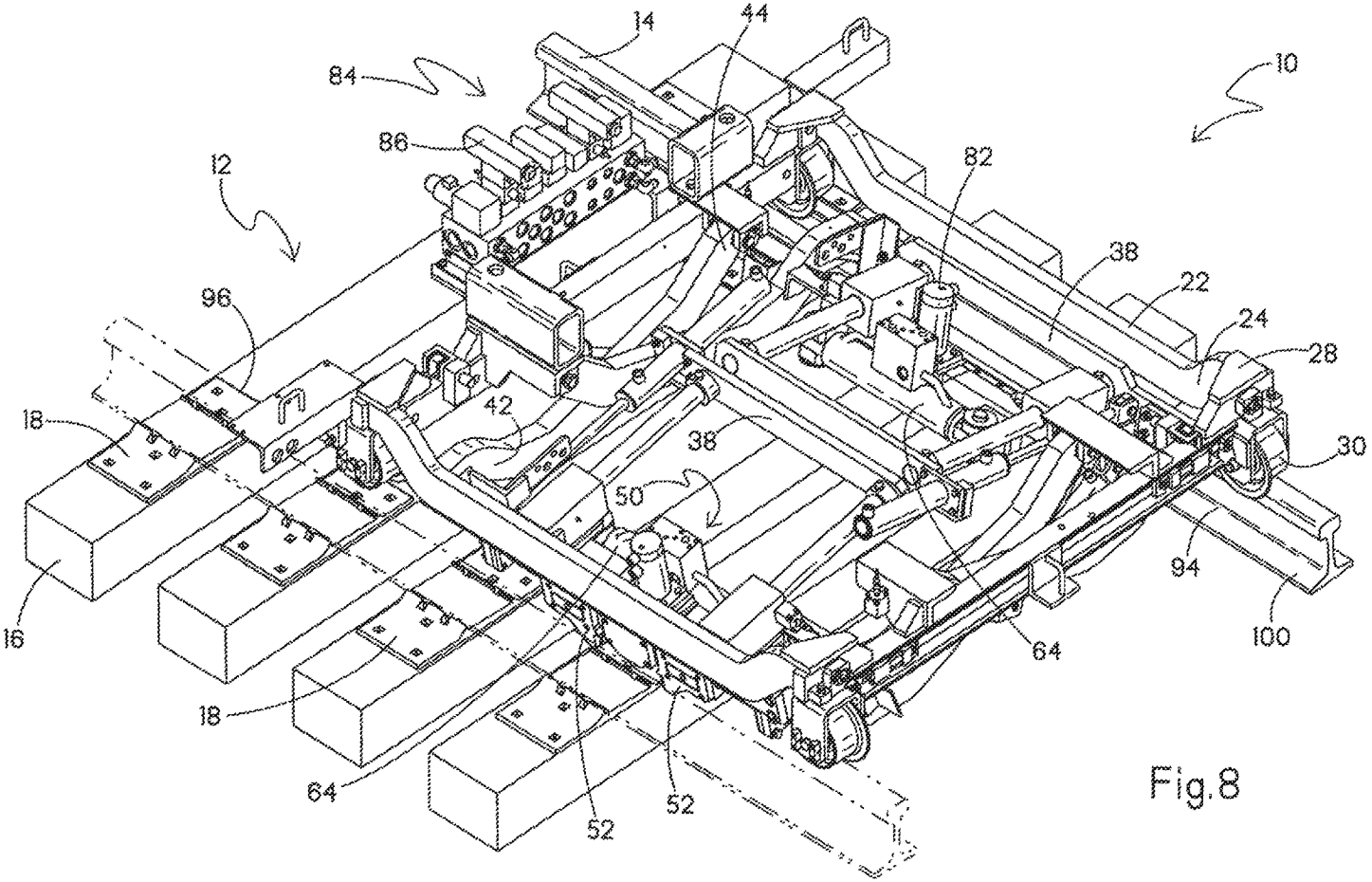
FIG. 8 is a top perspective elevation of the device of FIG. 1 shown with the plate in place and the rail lowered in position.
Figure 12:
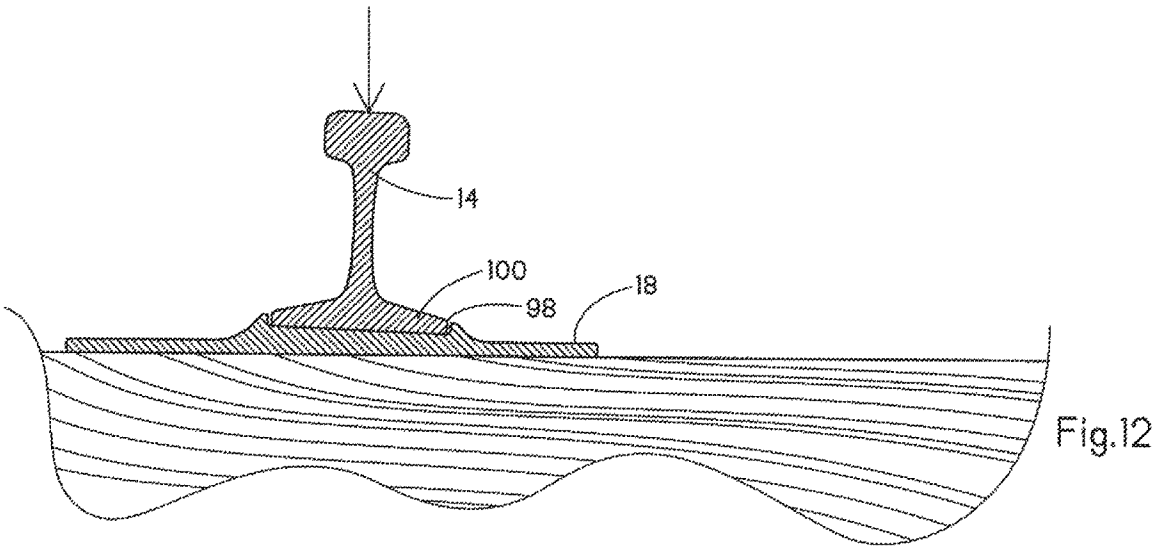
FIG. 12 is a schematic side elevation of the present method where the rail is lowered upon the tie plate.

Referring now to FIGS. 8 and 12, the rail 14 is lowered upon the plate 18, which is properly aligned on the tie 16 and is ready for fastening, such as by an automatic spike driver or the like, as is well known in the art.

Figure 13:
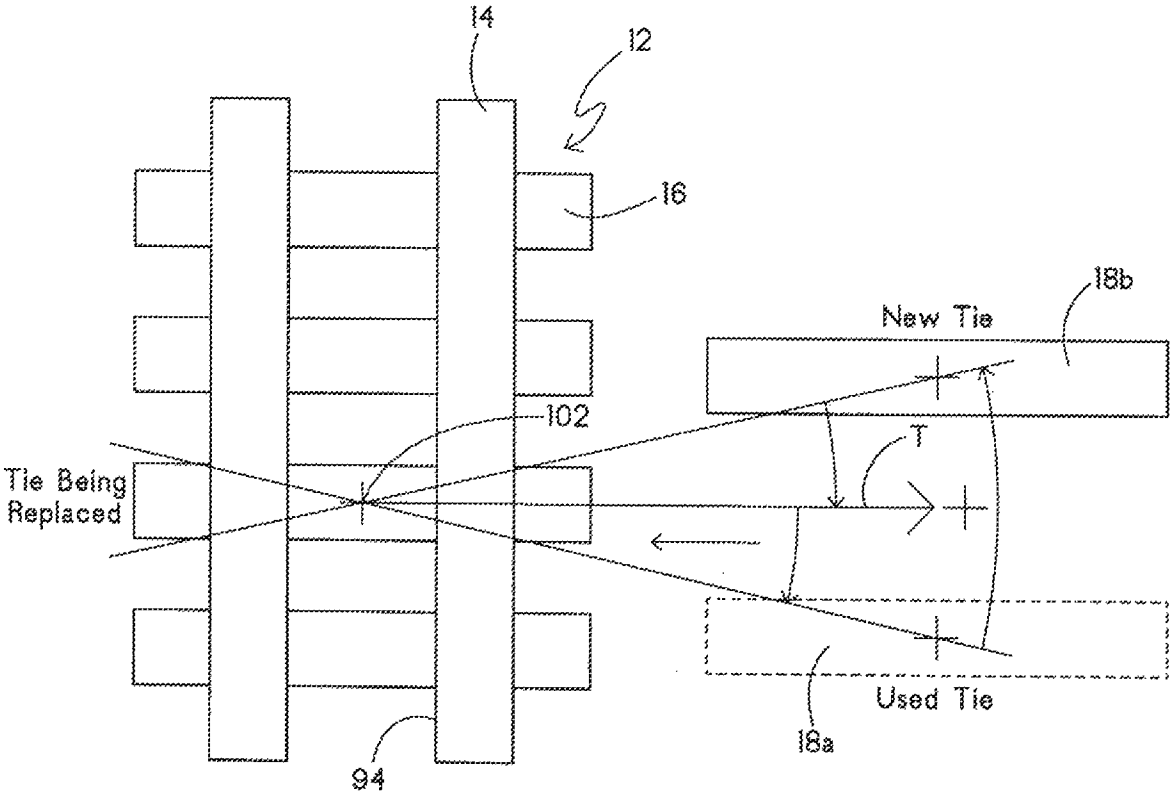
FIG. 13 is a schematic plan view of the proposed tie extraction portion of the present system.

Referring now to FIG. 13, an optional tie exchange process is depicted. The used tie 18*a* is extracted transversely relative to the track 12. A lifting device shown schematically at 102, such as a rotating crane, lifts the used tie 18*a* and rotates it away from the transverse axis "T". A new tie 18*b*, located along an arc of the crane and also displaced from the axis "T," preferably opposite the location of the used tie 18*a*, is available for selection by the crane and placement back along the axis "T." The tie extraction/insertion device then inserts the tie beneath the track 12.

Referring now to FIGS. 14-18, an alternate embodiment of the present rail plate handling device 10 is generally designated 110. Components shared with the device 10 described above are designated with identical reference numbers. Also, as in the case of the embodiment 10, there are a pair of gripping assemblies 50, one associated with each side of the device 110, and associated with one of the rails 14 of the railroad track 12 being repaired. Thus, the following discussion will focus on one of the gripping assemblies 50, with the understanding that there are two such assemblies on the device 110.

In operation of the device 10, it has been found that in some cases, on existing railroad track 12, in some cases the tie plates 18 are not properly aligned on the ties 16 so that long edges 112 of the plates, also referred to as front and rear edges, are not parallel with corresponding edges 114 of the ties 16. In other cases, the ties 16 are not properly aligned, in other words, they are not perpendicular to the rails 14 Railroad regulations require that a rail plate 18 placed on top of a rail tie and under the rail 14 must be aligned to the top of the tie so that the plate will not overhang edges of the tie. In the following discussion, the rail plate 18 being placed can also be referred to as a target plate or a selected plate, since the device 110 is designed for handling a sequence of such plates in the course of performing railway track maintenance.

Since the device 10 is constructed and arranged to pick up the tie plates 18 and preserve their position relative to the ties, upon insertion of a new tie, there is a chance that misalignment of the plate may occur. Thus, a need has developed for more positively aligning the corresponding long edges 112 of the tie plates 18 with corresponding long edges 114 of the ties.

It has also been found that during the tie plate removal and replacement process, the action of the gripping jaws 52 and the contacting guide 66, controlled by the gripping cylinder 64, often become locked on the jaw guide bar 58. This locking action has been found to contribute to the perpetuation of the misaligned position of the tie plate 18, or also prevents the accurate positioning of a correctly positioned tie plate located on a misaligned tie 16, when that tie is replaced with a correctly aligned tie.

This locked positioning of the gripping jaws 52 and the rail plate contacting guide 66 on the jaw guide bar 58 has been addressed in the device 110 by allowing the guide bar to move relative to the main frame 22 in the direction of travel of the device 110, which is also the longitudinal axis of the track 12. In other words, the jaw guide bar "floats" relative to the main frame 22, as well as relative to the pivoting subframe 38. Modifications to the device 10 that result in the device 110 having this relative guide bar movement include creating openings (not shown) at each flange 60 to which ends of the guide bar 58 are attached. The openings in the flanges 60 are dimensioned to allow free sliding movement of the guide bar 58 relative to the frame 22, and also relative to the flanges 60 on the subframe 38. Also, the guide bar 58 has been lengthened from the version described in relation to the device 10, so that end portions of the guide bar 58 extend past the corresponding flanges 60.

In addition, the jaw guide bar 58 is provided with a reduced diameter end 116 that slidingly engages a complementarily dimensioned opening in the adjacent flange 60*r*. A biasing element 118, preferably a coiled spring, is slidably engaged on the end 116 externally of the flange 60*r* and is held in place with a cup-shaped cap 120 that is secured to the end 116 of the jaw guide bar 58. It will be seen that the flanges 60, 60*r* are held together by a support bar 122 to form an inverted "U"-shape in which the guide bar 58 is slidably engaged. The biasing element 118 is provided for biasing or urging the guide bar 58 into a desired position relative to the subframe 38.

Figure 17:
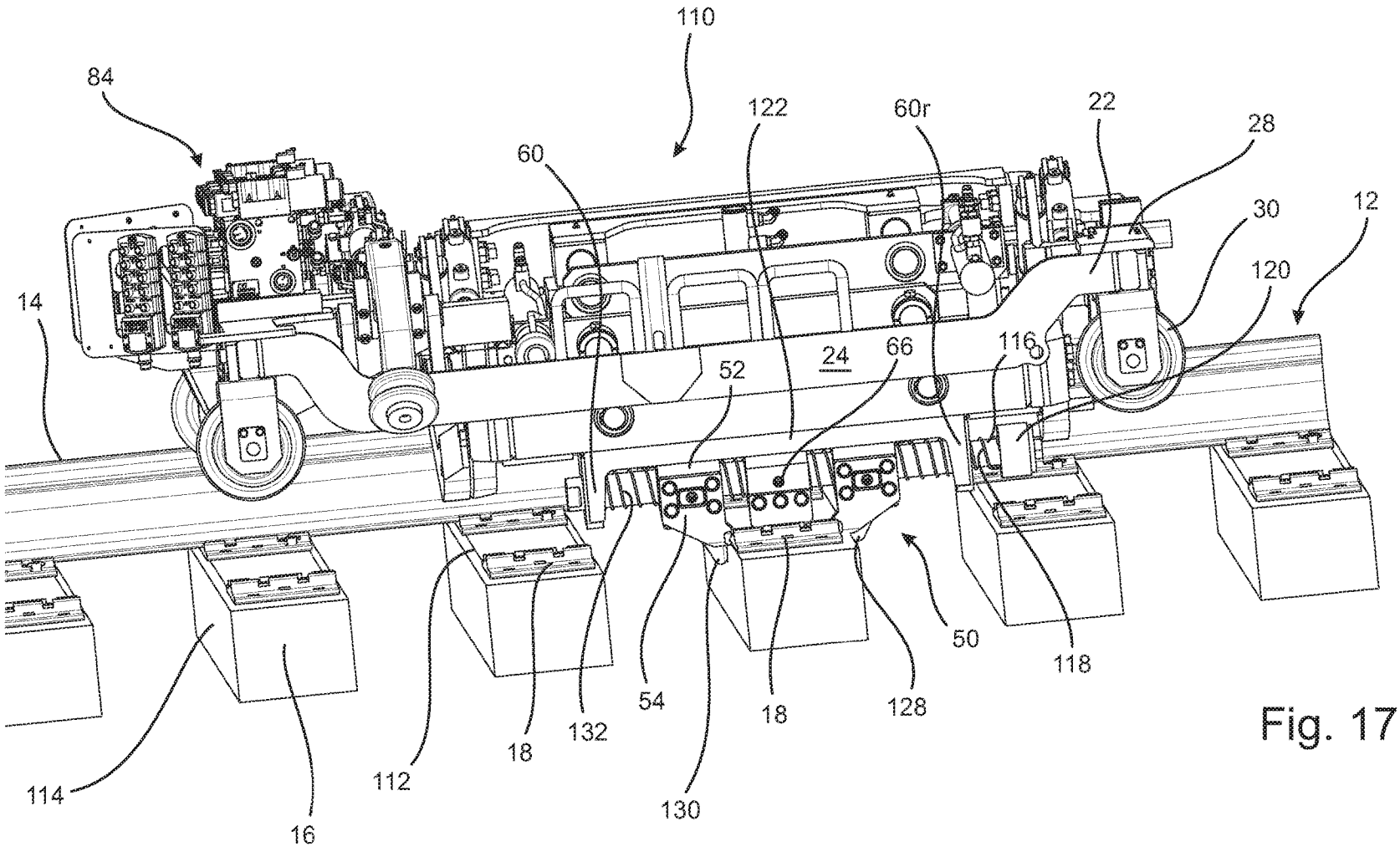
FIG. 17 is a side view of the device of FIG. 14 in a fourth position of plate orientation.
Figure 18:
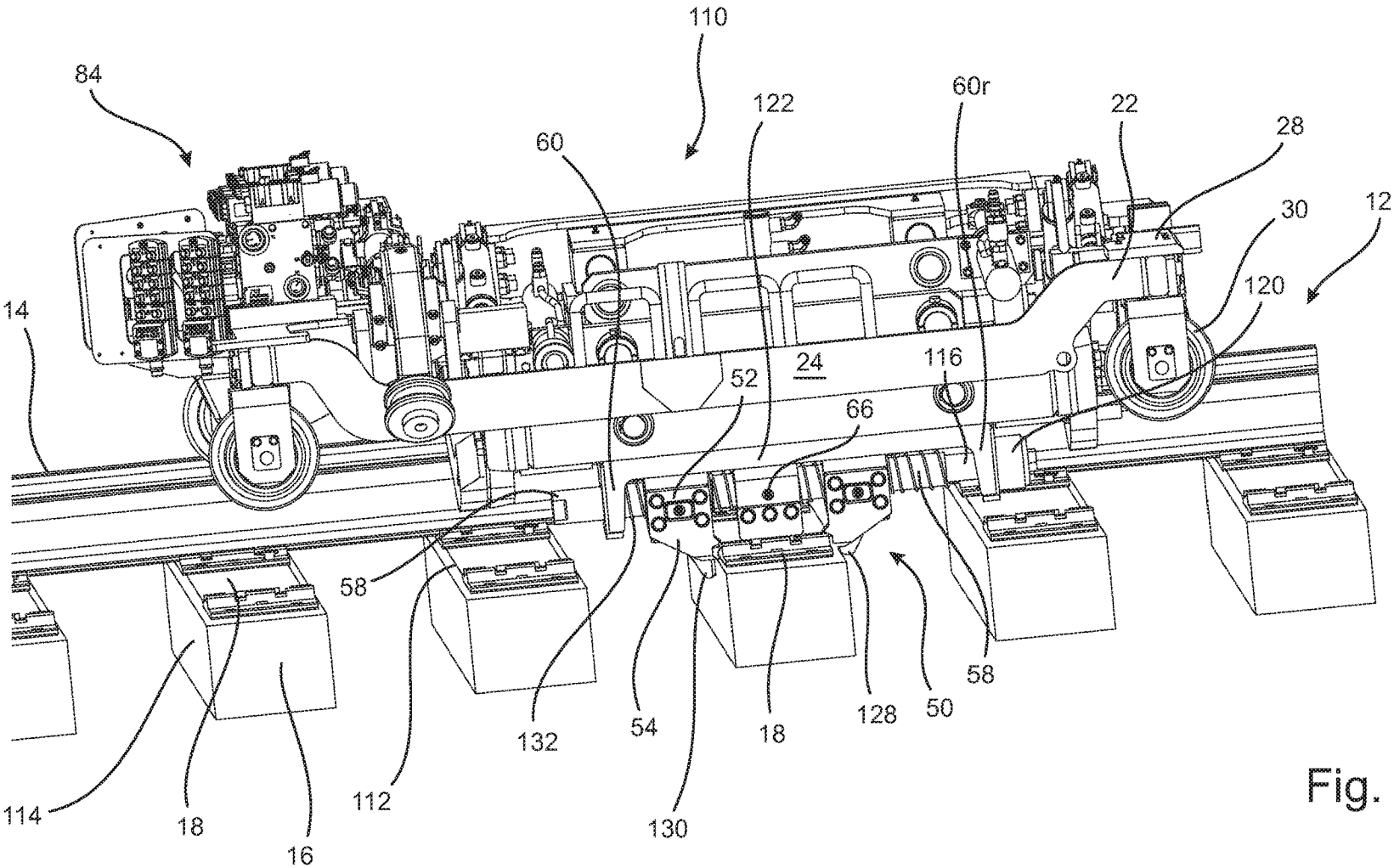
FIG. 18 is a side view of the device of FIG. 14 in a fifth position of plate orientation.
Figure 19:
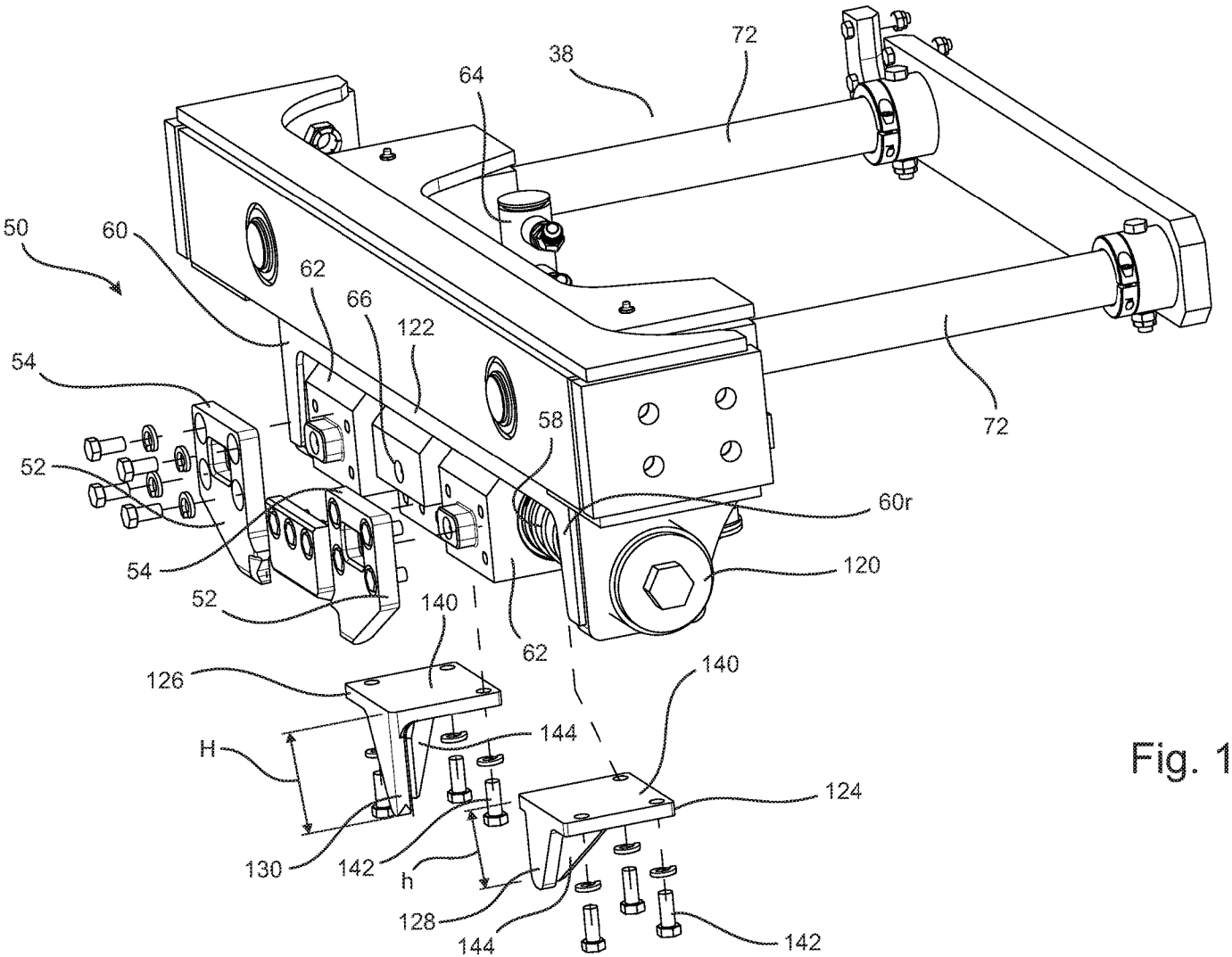
FIG. 19 is a fragmentary exploded perspective view of the present jaw block and plate alignment bracket for use in the device of FIG. 14.

Referring to FIG. 19, another modification, described in more detail below, is that the gripping jaws 52 are each provided with a respective front and rear alignment plates 124, 126 that actually engage the tie plates 18 and align them with the corresponding edge 114 of the tie 16. It will be seen that the front alignment plate 124 has a depending finger 128 that is shorter than a depending finger 130 of the rear alignment plate 126. Also seen in FIGS. 14-18 are a pair of centering springs 132 which act to return the gripping jaws 52 to a desired center position upon depressurization of the gripping cylinder 64.

Figure 14:
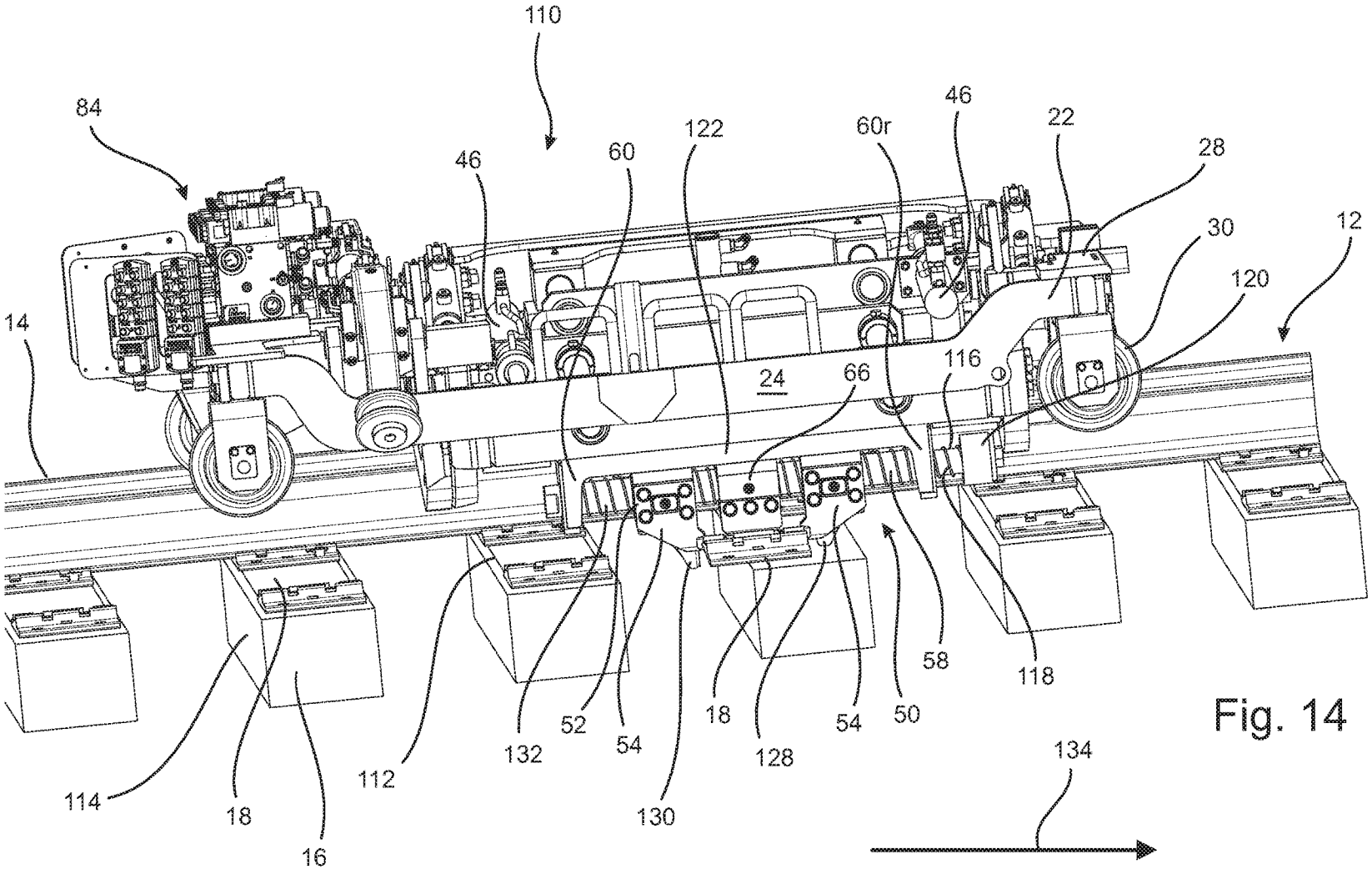
FIG. 14 is a side view of another embodiment of the present plate handling device in a first position of plate orientation on a replaced tie.

Referring now to FIG. 14, the present plate handling device 110 is depicted in the process of placing a tie plate 18 upon a recently inserted rail tie 16. The tie plate 18, which is grasped by the gripping jaws 52, is held suspended above the tie 16 as the device 110 moves along the track in the direction indicated by the arrow 134.

Figure 15:
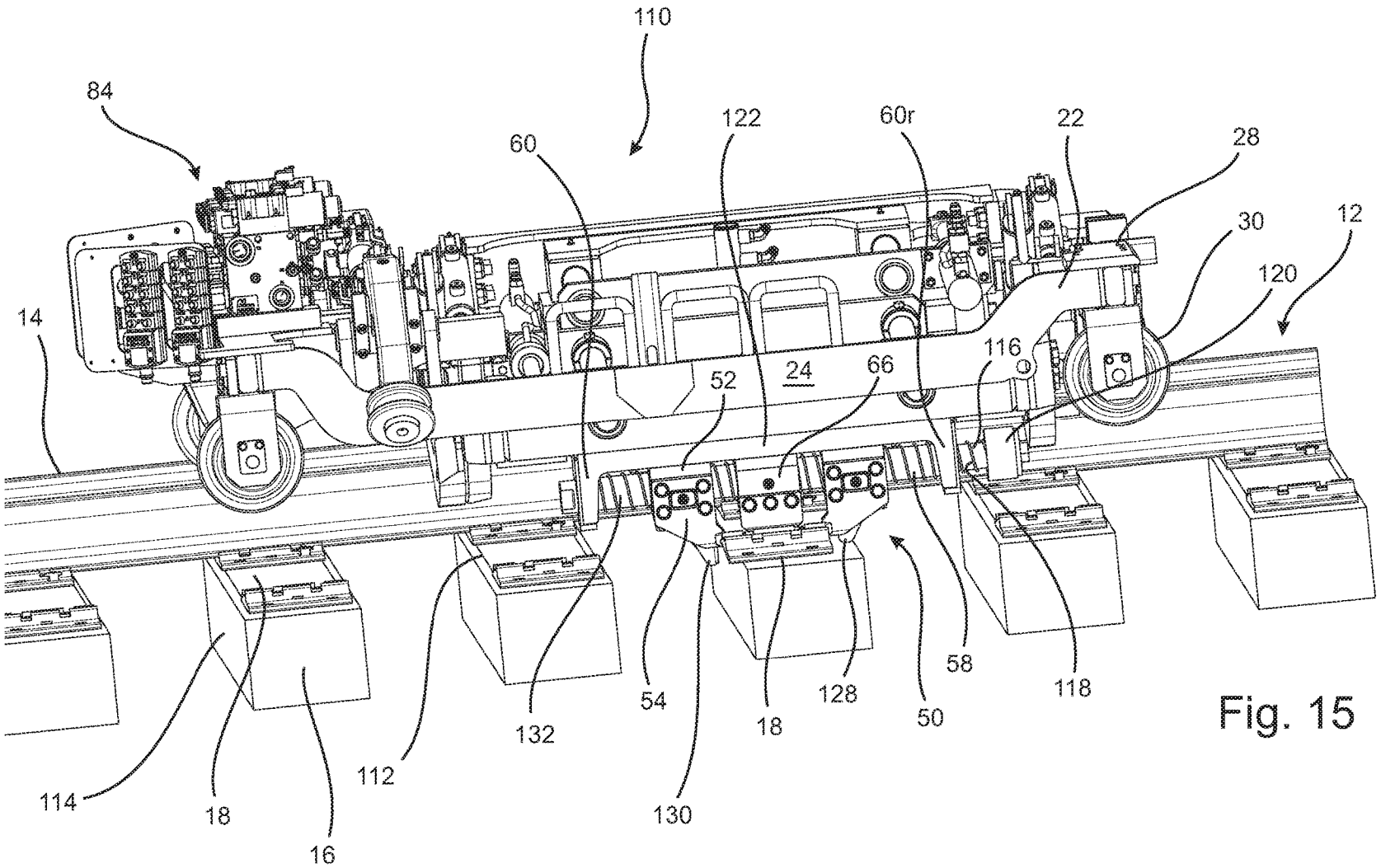
FIG. 15 is a side view of the device of FIG. 14 in a second position of plate orientation.

Referring now to FIG. 15, the plate handling device 110 moves closer to the tie 16, and the grasped tie plate 18 is gradually moved into position. In this vertically suspended position, the front alignment plate finger 128 will clear the tie 16, however, the rear alignment plate finger 130, which is longer and depends farther than the front finger 128, will eventually contact the edge 114 as the device 110 approaches the tie. An important design factor in the dimensioning of the fingers 128, 130 is that they are not overly long so as to drag in the rail ballast and thus potentially draw individual ballast stones onto the tie plate to interfere with the placement process.

Figure 16:
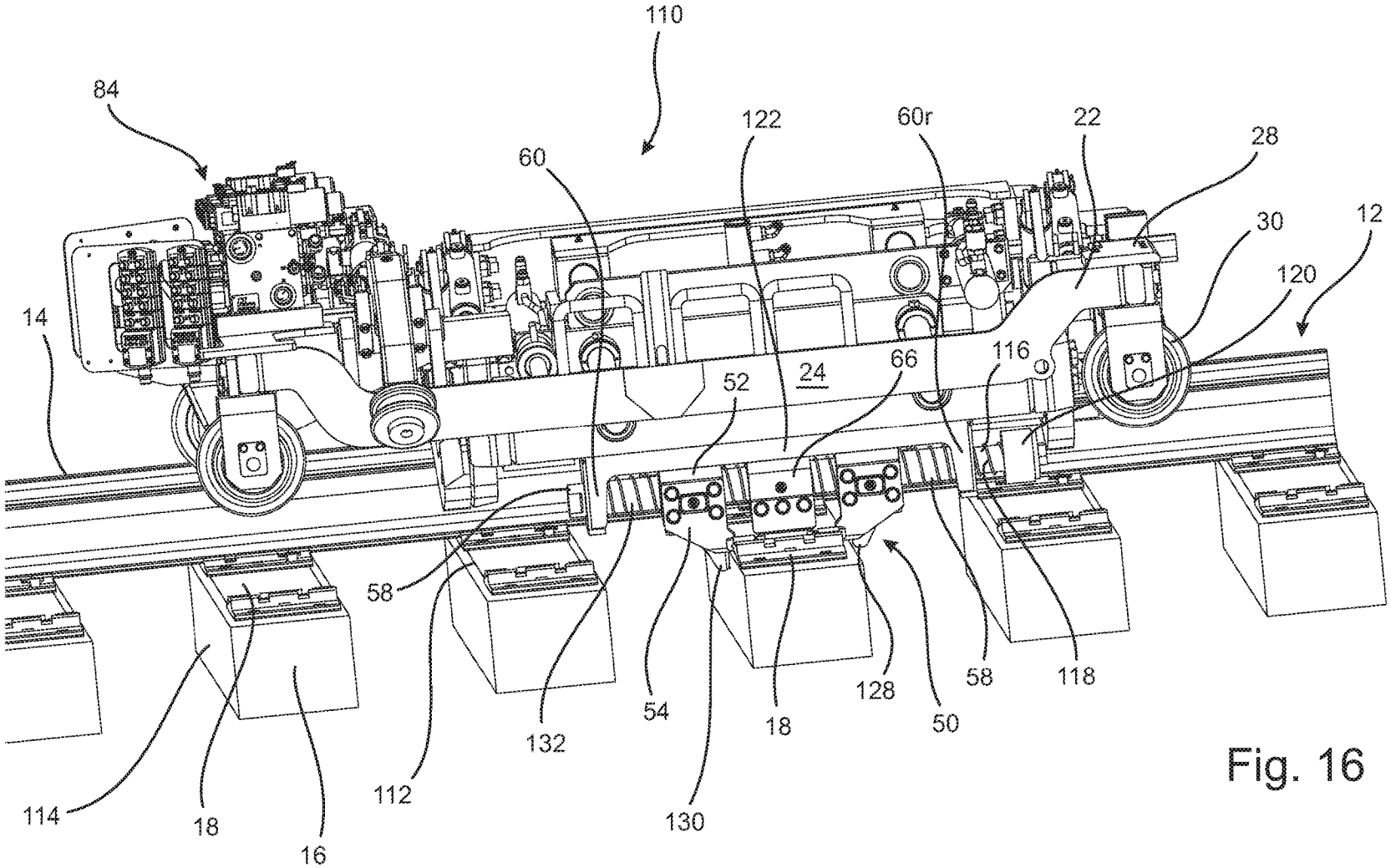
FIG. 16 is a side view of the device of FIG. 14 in a third position of plate orientation.

As seen in FIG. 16, the rear alignment plate finger 130 has contacted the edge 114 of the tie 16, thus achieving the desired alignment of the tie plate edge 112 with the tie edge 114. Referring now to FIG. 17, due to the pivoting action of the subframe 38, the guide bar 58, the flanges 60, 60*r* and the associated gripping jaws 52 and the rail plate contacting guide 66 all move as a unit with the grasped plate 18 to lower the plate upon the tie. It will be seen in this view that the biasing element 118 is not compressed at this point. Also, as described above, at this stage, due to the action of the gripping cylinder 64, the gripping jaws 52, the rail plate contacting guide 66 and the plate 18 are all locked relative to, and move as a unit with, the guide bar 58. Also, the depending fingers 128, 130 on the alignment plates 124, 126 cooperate in positively aligning the plate 18 on the tie 16.

Referring now to FIG. 18, the plate handling device 110 is moved a short distance, in the range of 1-6 inches, in the direction of travel. Despite this movement, the guide bar 58 and the associate gripping jaws 52 as well as the tie plate 18 remain in place on the tie 16, with the tie plate properly aligned. At this point, the biasing element 118 is compressed with in the cap 120, and thus there is a stored biasing force that is urging the guide bar to a centered position, but is prevented by the position of the device 110 and the locked nature of the gripping jaws 52.

At this point, the operator, or the control circuit 88, causes the gripping cylinder 64 to depressurize, releasing the gripping jaws 52 from the plate 18, since the plate is properly positioned and aligned on the tie 16. Soon after this depressurization, the subframe 38 is rotated up out of engagement with the tie plate 18 and the tie 16, and the device 110 is moved to the next operational location.

Referring now to FIG. 19, the assembly of the front and rear alignment plates 124, 126 is shown in greater detail. Each plate 124, 126 has a base 140 which is mounted, using threaded fasteners 142, to an associated guide block 62. The guide block 62 also receives one of the gripping jaw plates 54 to form the gripping jaw 52. In addition to the base 140, each of the alignment plates 124, 126 preferably includes a support gusset 144 which provides structural support for the fingers 128, 130. In the preferred embodiment, the fingers 128, 130 are integrally formed, as by casting or the like, however fabrication techniques are also contemplated, as are known in the art. It is seen in FIG. 19 that the front depending finger 128 has a height 'h' that is shorter than the corresponding height 'H' of the rear depending finger 130. Also, the relationship between the sliding jaw guide bar 58 and the pivoting subframe 38 is shown in greater detail.

An advantage of the device 110 is that in the event a tie 16 is encountered that is skewed relative to the track 12, the left side gripping assembly 50 is able to deflect differentially from the right side gripping assembly to accommodate this condition, ant to facilitate the properly aligned insertion of a replacement tie. By using the rear alignment plate 126 with the longer depending finger 130 to engage the plate 18 and the tie 16, the plate is more positively aligned on the tie. Further, once the gripping assembly 50 is lowered (FIG. 17), the front depending finger 128 assists in achieving proper plate alignment.

While a particular embodiment of the present rail tie plate handling system has been disclosed herein, it will be appreciated by those skilled in the art that changes and modifications may be made thereto without departing from the invention in its broader aspects and as set forth in the following claims.

The invention claimed is:

1. A rail plate handling device for removing and reinstalling rail tie plates located on rail ties on a railroad track having a pair of rails, each tie plate supporting one of the rails on an associated tie and having front and rear edges corresponding to the direction of travel along the railroad track, wherein at least one of the rails is raised from an operational position during the plate removal and installation process, said device comprising:

a frame configured for movement relative to the track;

at least one tie plate gripping assembly mounted to said frame, said assembly configured for grasping a selected tie plate at the front and rear edges between an adjacent one of the at least one raised rail raised from the operational position supported by the selected tie plate and the associated tie in the operational position upon which the plate was resting, each said gripping assembly including a pair of opposing gripping jaws which are configured for controlled reciprocation in a direction parallel to the rails along a guide bar, said guide bar being slidable with said gripping jaws and the selected plate, relative to said frame.

2. The device of claim 1, wherein said frame includes at least one pivoting subframe, and said gripping assembly is movable with said subframe, and said guide bar is slidable relative to said subframe.

3. The device of claim 2, wherein said guide bar is provided with a biasing element for biasing said guide bar into a desired position relative to said subframe.

4. The device of claim 3, further including a cap secured to an end of said guide bar for retaining said biasing element in position against the subframe.

5. The device of claim 1, wherein said frame is provided with a pair of said gripping assemblies including said slidable guide bar, one said assembly associated with a corresponding side of said frame.

6. The device of claim 1, wherein said frame includes at least one pivoting subframe, and said guide bar extends through openings in said subframe so that said guide bar moves in the direction of travel of said device independently of said subframe without becoming disengaged from said subframe.

7. The device of claim 1, wherein each said gripping jaw includes an alignment plate constructed and arranged for engaging a rail tie upon which a selected rail plate is placed.

8. The device of claim 7, said alignment plate includes a front alignment plate and a rear alignment plate, each associated with an edge of the selected rail plate.

9. The device of claim 8, further including a finger depending from each of said front alignment plate and said rear alignment plate for engaging the rail tie, said finger on said rear alignment plate being longer than said finger on said front alignment plate.

10. The device of claim 1 further including a rail plate contacting guide slidably engaged between said jaws for contacting an upper surface of the tie plate and adjusting the height of said subframe so that said gripping jaws are properly positioned.

11. The device of claim 1 further including a control mechanism for sequentially triggering and controlling the lowering of said at least one tie plate gripping assembly mounted to the frame to the operational vicinity of a tie plate, the grasping of a selected tie plate, the pulling the plate inwardly away from the rail and upwardly away from the tie, the suspension of the tie plate above the track while the tie is extracted and a new tie inserted, replacing the same tie plate upon the new tie, and moving the tie plate along the new tie towards the associated rail from a gage side of the rail.

12. A rail plate handling device for removing plates located on rail ties on a railroad track having a pair of rails, said device comprising:

a frame configured for movement relative to the track;

at least one subframe pivotally engaged on said frame for movement between a raised and a lowered position;

at least one tie plate gripping assembly mounted each said subframe, said subframe including a pair of opposed gripping jaws configured for grasping a selected tie plate, said gripping jaws being disposed on a jaw guide bar that is slidably engaged on said subframe; and a control system connected to said at least one tie plate gripping assembly for removing a selected tie plate away from the rail from a gage side of the rail and for retaining the tie plate while the tie is replaced, and for replacing the tie plate upon a new tie and moving the tie plate towards the associated rail from the gage side.

13. A process for replacing a tie plate on a railroad track during exchange of a tie, using a movable tie plate exchange device having at least one pivoting subframe and a pair of opposed, tie plate gripping jaws, comprising:

a. extending and lowering jaw-bearing arms of each subframe;
b. closing the jaws;
c. lifting the rail;
d. retracting and raising the arms, holding the plate suspended above the track;
e. lowering the rail;
f. removing the tie using a tie exchanging apparatus;
g. obtaining a new tie and inserting the tie beneath the rail in the location of the previous tie;
h. lifting the rail;
i. lowering arms of the subframe, such the plate is located on top of the tie;
j. gripping the plate using a pair of gripping jaws located on a jaw guide bar, said jaw guide bar being slidable relative to said subframe;
k. extending the plates toward the rail, such the field side lip of the plate is part way under the rail;
l. raising a gage side of the plate and continuing to move the plate towards the rail;
m. the gage side lip of the plate engages the base of the rail, assuring proper left to right placement.
n. lowering the rail; and
o. releasing the jaws, return the subframe to a travel position.

* * * * *